United States Patent [19]

Martin

[11] 4,275,518

[45] Jun. 30, 1981

[54] DECORATIVE PLATE AND METHOD OF MAKING SAME

[75] Inventor: Lindley Martin, Gold Coast, Australia

[73] Assignee: Roderick R. Mayze, Paradise Point, Australia

[21] Appl. No.: 345

[22] Filed: Jan. 2, 1979

[30] Foreign Application Priority Data

Mar. 29, 1978 [NZ] New Zealand ..... 186798

[51] Int. Cl.[3] ..... A45C 11/00

[52] U.S. Cl. ..... 40/324; 40/10 D; 428/13; 428/192

[58] Field of Search ..... 40/10 D, 324; 428/13–14, 192; 131/231, 240 R, 241, 242; 156/224

[56] References Cited

U.S. PATENT DOCUMENTS

| | | | |
|---|---|---|---|
| 286,118 | 10/1883 | Craighead | 40/152 |
| 1,225,179 | 5/1917 | Rudolph | 428/14 X |
| 2,214,030 | 9/1940 | Pereles | 428/13 X |
| 2,224,683 | 12/1940 | Ide et al. | 428/13 X |
| 3,515,262 | 6/1970 | Ornstein et al. | 215/100.5 X |
| 3,582,452 | 6/1971 | Britton | 428/209 |
| 3,886,677 | 6/1975 | Behring et al. | 428/14 X |
| 4,014,122 | 3/1977 | Woods | 428/13 X |
| 4,173,667 | 11/1979 | Rusch | 428/14 X |

*Primary Examiner*—Henry F. Epstein
*Attorney, Agent, or Firm*—Julian Caplan

[57] ABSTRACT

A decorative plate consists of an outer part having a base with curved sides terminating in a peripheral lip. This part may be suitably decorated. An inner part is formed complementary to the interior of the outer part, and is preferably of a clear material, such as a plastic. On the back of the inner part there is preferably a foil ring. Prior to assembly of the inner part and the outer part, a photograph may be prepared and inserted inside the foil ring. Thereupon the inner part is pressed toward the outer part until the edge of the inner part snaps under the lip. The completed dish may be used as a decorative plaque, tray, ash tray, or for other purposes.

3 Claims, 4 Drawing Figures

DECORATIVE PLATE AND METHOD OF MAKING SAME

This invention relates to an improved decorative plate and method of making same and, in particular, to a decorative plate and method of making same which may be used as a mount for a scenic or other photograph or for advertising material.

Decorative plates have been available for many years, predominately as souvenirs sold in gift shops and tourist resorts. Known decorative plates may take many forms. A scene or advertising material may be painted on the plate, or if the plate is of ceramic material, form part of the glazing.

Alternatively, the scene may be molded to form an integral part of the plate.

The first two methods are relatively expensive and require the need for skilled craftsmen. The molding method is cheaper but inflexible as each different scene or piece of advertising material requires a separate mold.

Therefore, it is an object of the present invention to provide a decorative plate which is economically produced while allowing flexibility in the range of material which may be displayed.

It is a further object of the present invention to provide such a plate in two parts which may be held together by a "snap-fit", without the need for clips or other fasteners.

A still further object is to provide such a plate where the display material can be accurately mounted on one of the parts of the plate before the latter is assembled.

In a preferred embodiment of the invention, a photograph, preferably a color instant photograph, of the subject is taken and while the print is wet cut to size and positioned on the back of the inner member within the foil ring. If desired, the photograph may be glued in position. Thereupon the inner member is snapped in position relative to the outer member. The outer member is preferably of a ceramic or high density polyethylene material and may be decorated with the name or logo of a hotel, place of entertainment or other locality where the picture has been snapped.

Further objects of the present invention will become apparent from the following description.

In the broad aspect, the invention resides in a decorative plate having:

an inner part;

an outer part;

integral means on one of said parts to secure said parts together.

Preferably, the integral securing means is an inwardly directed lip adapted to engage over an edge of the other of the said parts.

Preferably, suitable display material is fixed to one of the parts before the plate is assembled and is captively secured between the two parts.

To enable the invention to be more fully understood, a preferred embodiment will now be described with reference to the accompanying drawing showing a section view of the plate when assembled.

Figure 1:
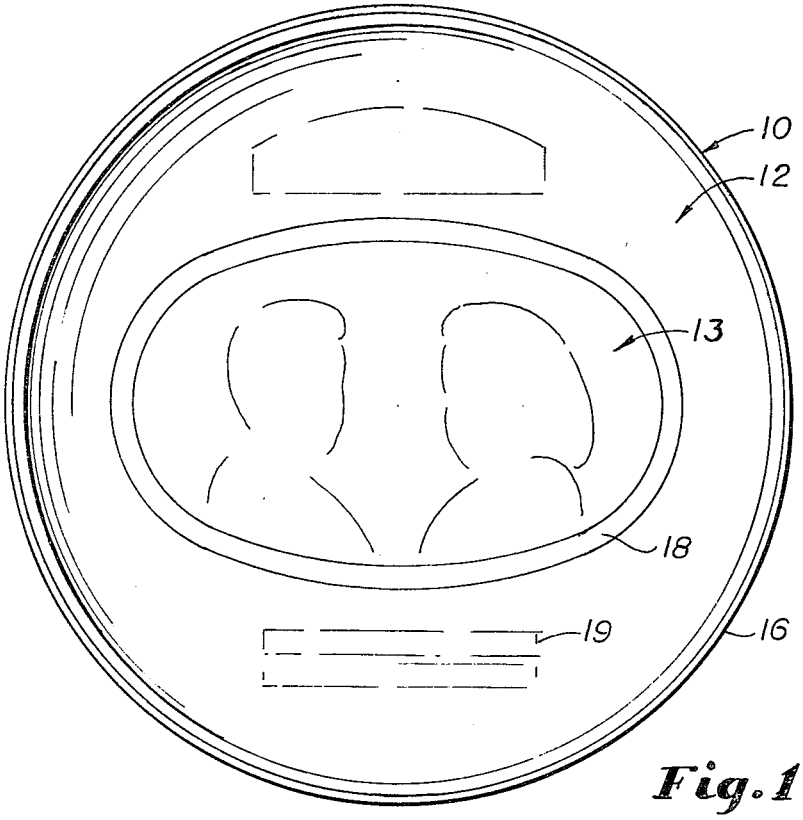
FIG. 1 is a top plan view of a completed plate in accordance with the present invention.
Figure 2:
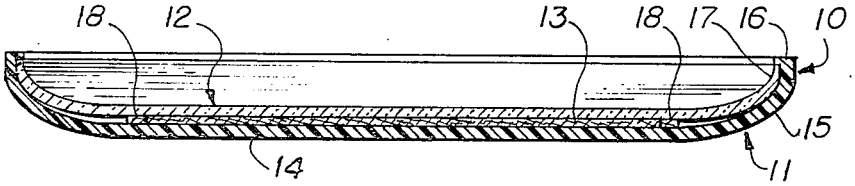
FIG. 2 is a mid-section thereof.
Figure 3:
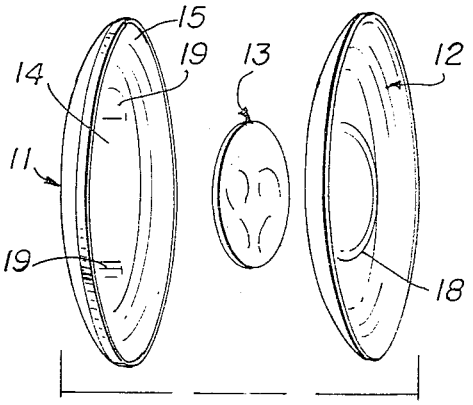
FIG. 3 is an exploded perspective view showing that part prior to assembly.
Figure 4:
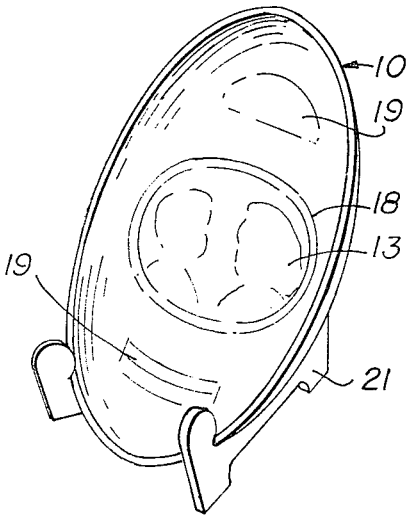
FIG. 4 is a perspective view showing the completed plate displayed on a stand.

Plate 10 has an outer part 11, inner part 12 and display material 13, fitted between the two parts.

Outer part 11 is preferably circular in plan and convex in cross-section, having a base portion 14 and a curved wall 15. The wall 15 is surmounted by an integral inwardly-directed peripheral lip 16 having a width substantially equal to or just greater than the wall thickness of the inner part 12. The outer part is preferably formed of ceramic material or high density polyethylene and may be molded in a center injection mold.

Inner part 12 is of generally the same convex shape as the outer part 11 and is dimensioned to be closely fitted into the outer part. The integral lip 16 secures the inner part 12 in position through a "snap-fit" action and firmly engages the upper peripheral edge of the curved wall 17 of the inner part 12. The inner part is molded from clear (or crystal) styrene in a side injection mold, the unwanted injection flashing being removed by any suitable method or means.

For decoration, an embossed foil ring 18 may be heat pressed preferably into the front of the inner part 12.

The display material 13 may be in the form of a Polaroid (Registered Trade Mark) or other instant photograph, e.g., for souvenir photographs of people or scenery or other decoration. The photograph is taken and developed as per the camera manufacturer's instructions. The photograph is cut to the required size and shape and the wet surface is placed into contact with the rear of the inner part, adhering thereto. Other means of securing the photograph in position may be used. The inner part 12 is then snapped into place in the outer part 11 and the decorative plate is ready for sale.

Alternatively, the display material 13 may comprise printed material 19 before the plate 10 is assembled. The plate 10 is then assembled as shown in the drawing.

For display, the plate 10 may be placed on a suitable stand 21. Alternatively, a suitable hanging tag (not shown) may be fixed on the underside of the base portion 14 of the outer part 11 to engage a hook or nail fixed on a wall.

If, at any time, the display material 13 is to be changed, the lip 16 is rolled outwardly and a thin blade instrument is passed between the underside of the lip 16 and the upper peripheral edge of the curved wall 17 of the inner part 12. The inner part 12 may be levered free of the outer part 11 and the display material can then be removed.

The decorative plate described above incorporates components which are simple and economical to manufacture and the plate 10 is easily assembled. In addition, it can be used to mount an almost limitless range of display material 13 without incurring large costs, e.g., for new molding equipment, as the latter is changed.

Various changes and modifications may be made to the arrangement described and illustrated without departing from the present invention.

As used in the claims in describing the outer part 11, the term "rigid material" comprises ceramic material, high density polyethylene and equivalent.

What is claimed is:

1. A decorative plate comprising an outer part of a rigid material having a flat outer base and a curved outer wall, a transparent part of a flexible plastic material having a flat inner base and curved inner wall and an upper peripheral edge, said inner base and inner wall being complementary to the shape of the interior of said outer part, an integral inturned peripheral lip on said outer wall of said outer part, whereby the said parts may be secured together with a "snap-fit" action by said edge snapping under said lip and may be conveniently detached as desired by prying said edge from under said lip, and a photographic print positioned between said parts visible through said inner part, said photographic print being adhered to the back of said inner part.

2. A plate according to claim 1 which further comprises a foil ring on said inner part, said print located within said ring.

3. A plate according to claim 2 which further comprises decoration material on said outer part outside said ring and visible through said inner part.

* * * * *